United States Patent [19]

Allan

[11] Patent Number: 4,606,165

[45] Date of Patent: Aug. 19, 1986

[54] BUILDING PANELS

[75] Inventor: Ronald F. Allan, Townsville, Australia

[73] Assignee: Ron Allan Industries (Australia) Pty. Ltd., Queensland, Australia

[21] Appl. No.: 760,747

[22] PCT Filed: Oct. 12, 1983

[86] PCT No.: PCT/AU84/00200

§ 371 Date: Jun. 20, 1985

§ 102(e) Date: Jun. 20, 1985

[87] PCT Pub. No.: WO85/01766

PCT Pub. Date: Apr. 25, 1985

[30] Foreign Application Priority Data

Oct. 20, 1983 [AU] Australia ..... PG1948

[51] Int. Cl.[4] ..... E04B 2/82

[52] U.S. Cl. ..... 52/583; 52/656; 403/170

[58] Field of Search ..... 52/583, 656, 648, 485; 403/170, 231, 296, 189

[56] References Cited

U.S. PATENT DOCUMENTS 3,703,058 11/1972 Klett et al. ..... 52/583 X
3,898,777 8/1975 Georgiev et al. ..... 52/583 X
4,012,153 3/1977 Pidgeon et al. ..... 52/656
4,025,209 5/1977 Vollenweider ..... 52/656 X
4,164,831 8/1979 Messick et al. ..... 52/583 X

FOREIGN PATENT DOCUMENTS 845923 8/1960 United Kingdom ..... 52/583

*Primary Examiner*—J. Karl Bell
*Attorney, Agent, or Firm*—Oldham, Oldham & Weber Co.

[57] ABSTRACT

A rectangular concrete or like building panel (10) of substantially uniform thickness has connectors (11) inset into its top and bottom corners and securely fixed to metal members (14) embedded within the panel (10). Each connector (11) is a short tube, its ends flush with opposite faces of the panel (10) and with two exposed perpendicular sides substantially level with a side edge and a top or bottom edge of the panel (10), and formed with bolt holes (12) to enable generally similar panels (10) to be secured together by bolts (23) through adjacent connectors (11) and to be bolted to floor (30) and roof structures (41). Intermediate connectors (11*a*) may be inset and secured into the top and bottom of the panel (10), each with an exposed side flush with the panel's top or bottom edge and formed with a bolt hole (12).

5 Claims, 9 Drawing Figures

BUILDING PANELS

BACKGROUND OF THE INVENTION

1. Field of the Invention

This invention relates to building panels.

2. Brief Description of the Prior Art

Many different types of pre-fabricated building panels have been proposed for interconnection adjacently in the erection of the walls of houses or other buildings. The present invention has been devised with the general object of providing such building panels which are particularly sturdy and durable and incorporate connector means whereby the panels may be quickly and easily interconnected adjacently or at right angles, and also locked to a floor and to a roof or other superstructure.

SUMMARY OF THE PRESENT INVENTION

With the foregoing and other objects in view the invention resides broadly in a building panel of rectangular shape and of substantially uniform thickness, including top and bottom corner connectors inset and secured into the four corners of the panel, each having means for securing it to a corresponding connector of an adjacent similar panel, and also means for connection to a floor beneath, or a superstructure above, the panel. Preferably each connector is a square or rectangular section tubular member, its open ends flush with opposite faces of the panel, the connector being rigidly anchored to reinforcing rods or other metal members within the panel, its means for connection being bolt holes in the two sides of the connector exposed at the corner of the panel. Preferably similar connectors are similarly anchored at intermediate positions in the top and bottom of the panel, each with one exposed face, with bolt hole, flush with the top or the bottom of the panel. Other features of the invention will become apparent from the following description.

BRIEF DESCRIPTION OF THE DRAWINGS

In order that a preferred embodiment of the invention may be readily understood and carried into practical effect, reference is now made to the accompanying drawings, wherein.

DETAILED DESCRIPTION OF THE PREFERRED EMBODIMENT

The building panels 10 are all of cast reinforced concrete, of rectangular shape, of uniform thickness and of uniform hieght, but may be made to different widths and will normally include panels formed with doorways, windows and other openings (not shown) as required for the construction of a house or other building. Vertical and horizontal conduits for electric, plumbing and other services may also be cast into the panels.

Each building panel has at each corner a corner connector 11 and, in each panel 10, intermediate connectors **11*a*** are fixed centrally in its top and bottom.

Figure 2:
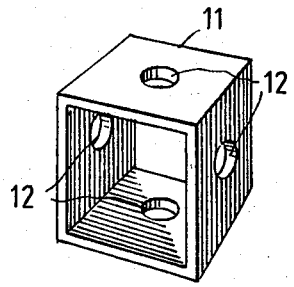
FIG. 2 is a prespective view of one of the connectors of a building panel.

Each of the connectors 11 and **11*a* is, as shown in FIG. 2, a length of square-section metal tube, its length being equal to its width and depth and to the thickness of the panel 10, a plain bolt hole 12 being formed centrally in each of its four sides. The open ends of each connector are flush with the parallel faces of the panel. The two exposed sides of each corner connector 11 are flush with an end, and with the top edge or the bottom edge, of the panel in which it is installed, and the single exposed side of each of the top and bottom intermediate connectors 11*a*** is flush with the top or the bottom edge respectively of the panel.

Figure 3:
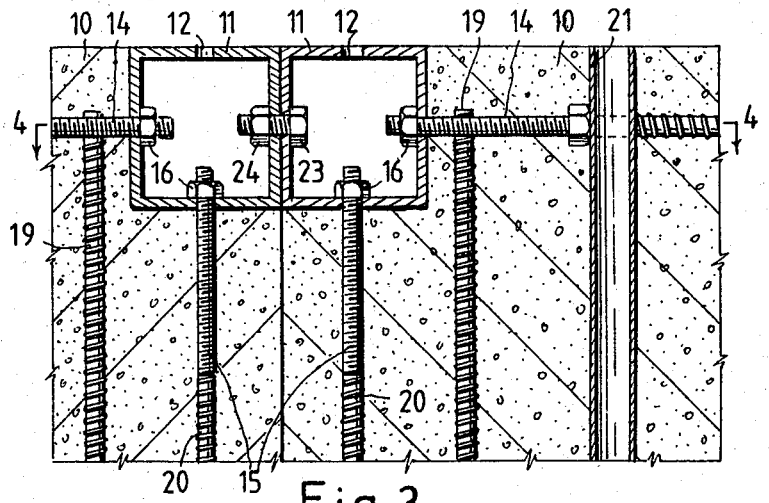
FIG. 3 is a sectioned elevational view of the parts of adjacent panels in the circle 3 of FIG. 1.
Figure 4:
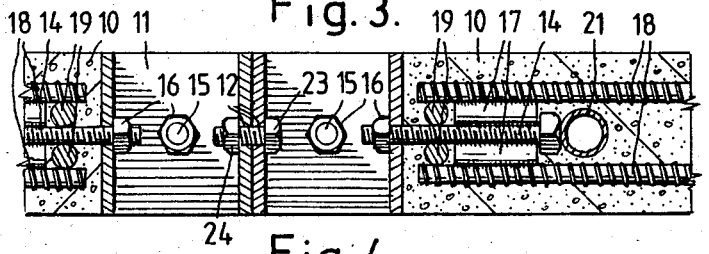
FIG. 4 is a sectional view of the adjacent panels taken along line 4—4 in FIG. 3.

The connectors 11 and **11*a* are securely anchored in the panels 10 as shown in FIGS. 3, 4, 5 and 6. Referring now to FIGS. 3 and 4, each corner connector 11 is anchored by a horizontal bolt 14 and by a threaded rod 15 passing through the bolt holes 12 of, respectively, the inner vertical and the inner horizontal sides of the connector, and being engaged by nuts 16. Otherwise, the bolt 14 and the threaded rod 15 are embedded in the concrete of the panel 10. The bolt 14 is welded between a pair of spacer rods 17 which in turn are welded between a pair of reinforcing rods 18 of the panel, these being secured to a pair of vertical reinforcing rods 19. The threaded rod 15 is welded between a pair of vertical reinforcing rods 20 of the panel. A vertical conduit 21 is cast in the panel between the horizontal reinforcing rods 18**.

Figure 5:
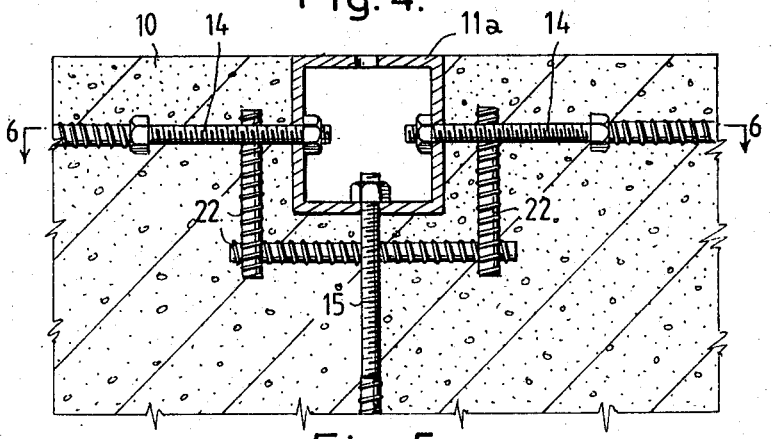
FIG. 5 is a sectioned elevational view of the part of a building panel in the circle 5 of FIG. 1.
Figure 6:
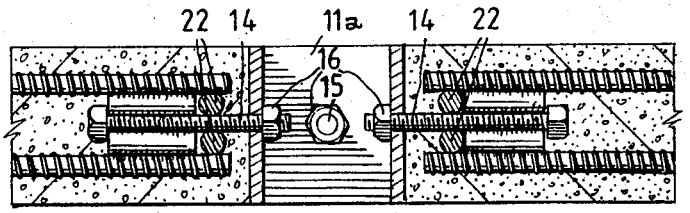
FIG. 6 is a sectional view of the panel taken along line 6—6 in FIG. 5.

FIGS. 5 and 6 show the anchorage of an intermediate connector **11*a* centrally within the top of a panel 10. Opposite vertical sides of the connector are entered by two bolts 14, the bottom of the connector is entered by a threaded rod 15, and the bolts and rod are engaged by nuts 16, substantially as before described. The opposed bolts 14 and the threaded rod 15 are rigidly interconnected by a bridge of reinforcing rod sections 22** welded together and to the bolts and the threaded rod.

The panels 10 are erected upon a floor, the panels being disposed adjacently or at right angles, as required, and being secured rigidly together, and to the floor. As shown particularly in FIGS. 3 and 4, adjacent panels 10 are fixed rigidly together by bolts 23 passed through registering bolt holes 12 of aligned upper corner connectors 11, nuts 24 being engaged and tightened on the bolts. The bottom corner connectors 11 of the two adjacent panels are likewise bolted together.

Figure 7:
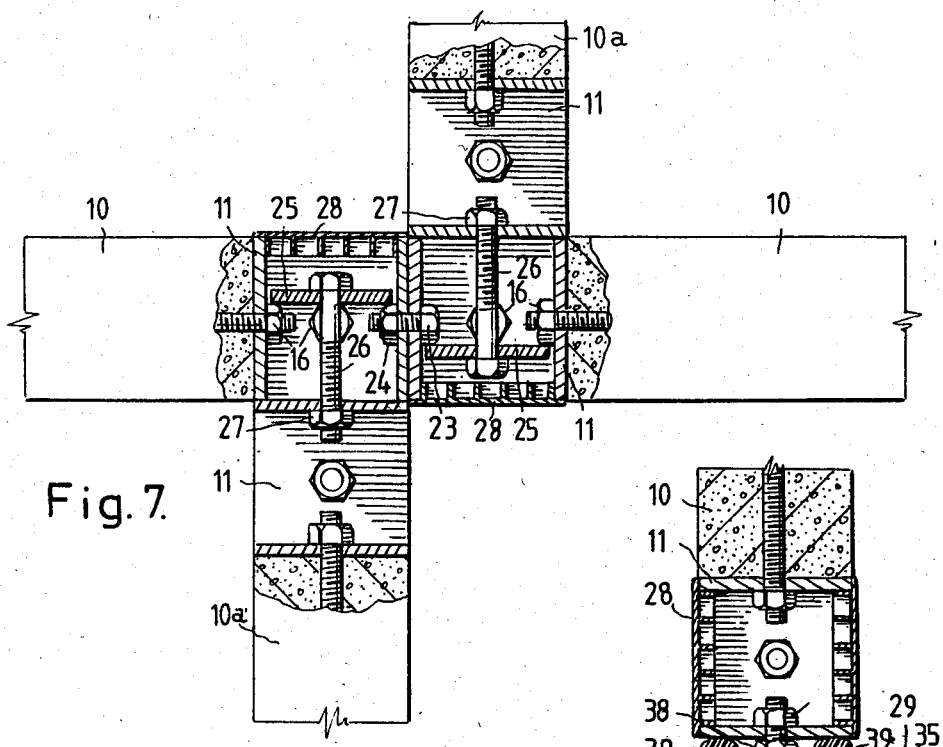
FIG. 7 is a partly sectioned plan view of the parts of interconnected building panels in the circle 7 of FIG. 7.

FIG. 7 shows adjacent panels 10 bolted together as described and further panels **10*a* fixed to extend perpendicularly in opposite directions from the two adjacent panels 10. In such a perpendicular connection when open ends of corner connectors 11 of a panel 10 are brought against sides of corner connectors 11 of a panel 11*a*, a centrally apertured tension plate 25 is inserted into each connector 11 of a panel 10 so as to bear against the nuts 16 and head of the bolt 23 or engaging nut 24. A bolt 26 is then passed through the central aperture of the tension plate and a bolt hole 12 of the connector 11 of the panel 11***a*, and is engaged by a nut 27. Exposed open ends of connectors 11 may be closed by end stops 28 which may be moulded of a suitable plastic material and are held frictionally in place.

Figure 1:
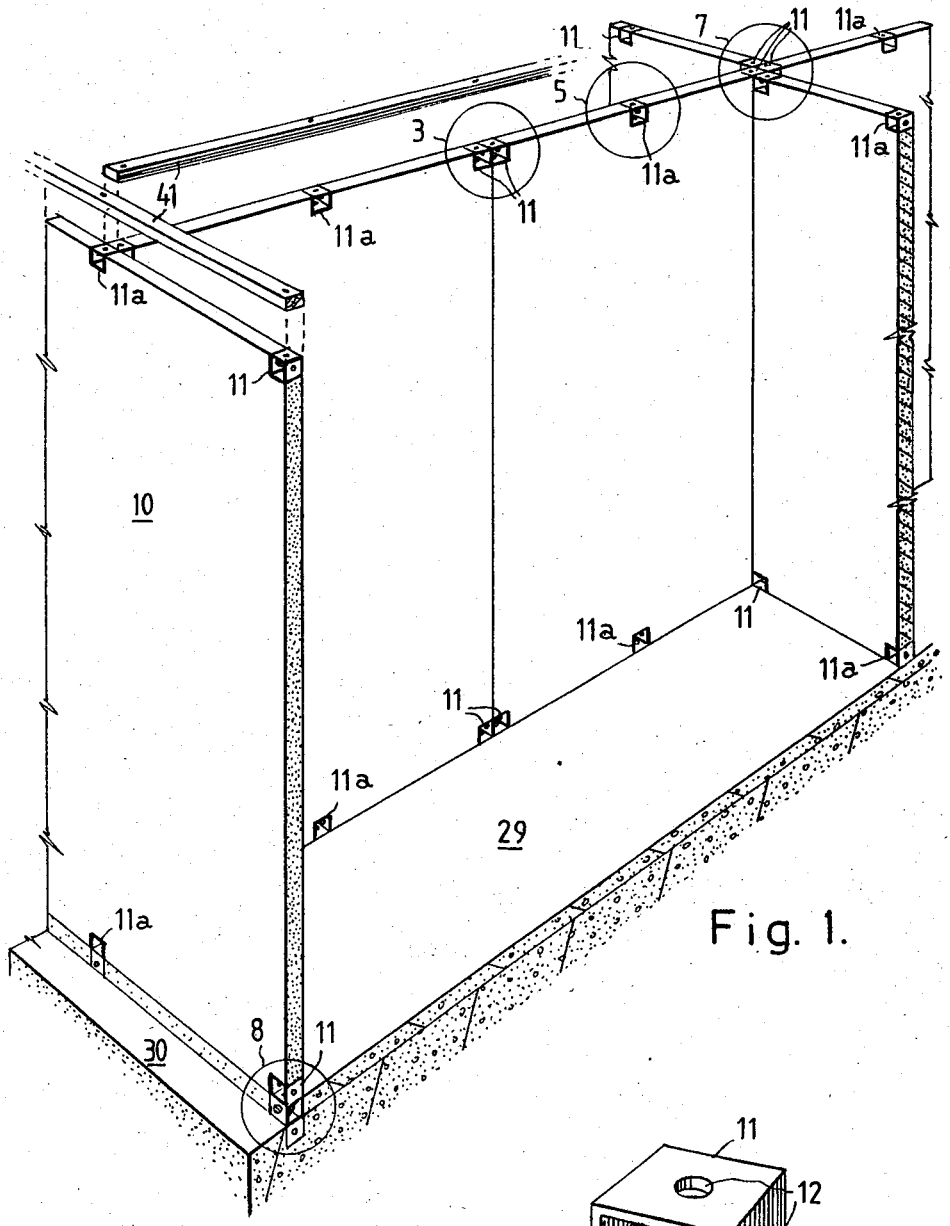
FIG. 1 is a partly broken-away perspective view of a number of building panels according to the invention erected upon a foundation.
Figure 8:
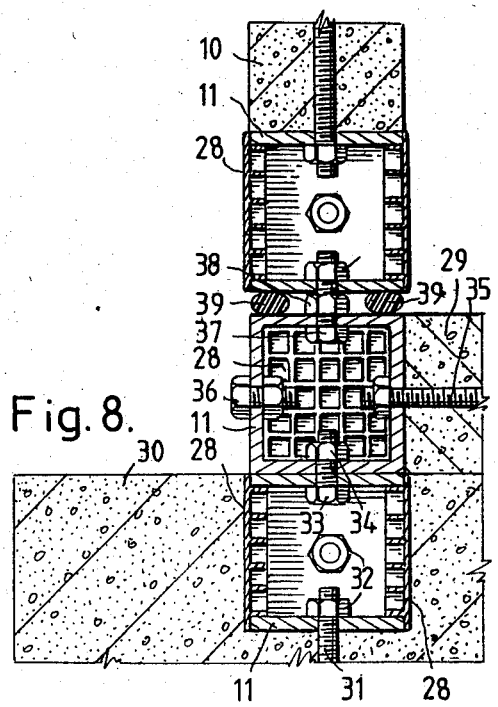
FIG. 8 is a sectioned elevational view of the parts of a building panel and foundation in the circle 8 of FIG. 1.

Referring now to FIGS. 1 and 8, the floor on which the panels 10 and 10*a* are erected is a concrete floor slab 29 laid upon a reinforced concrete foundation 30 in which are embedded foundation connectors 11*b* anchored by bolts and/or threaded rods 31 and nuts 32 and closed at their ends by end stops 28 to prevent entry of concrete during casting. Above each of these foundation connectors 11*b* there is secured, by a bolt 33 and nut 34, a floor connector 11*c* anchored in the floor slab 29 by a bolt 35 through its inner side, a bolt 36 through its outer side being available for holding the formwork for the floor slab. The ends of this connector 11*c* are also closed by end plugs 28 to exclude concrete. A bolt 37 passed up through the bolt hole in the top of the floor connector 11*c* is engaged by a nut 38 and extends for some distance above this nut. The bottoms of the panels 10 are set upon resilient sealing strips 39. The bolt 37 passes through the bottom of a bottom corner connector 11 of the panel 10 and is engaged by a further nut 40. The ends of the panel connector 11 may be closed by end plugs 28. To carry the roof structure of a building, top plates 41 may be bolted to the top connectors of the assembly of panels.

Figure 9:
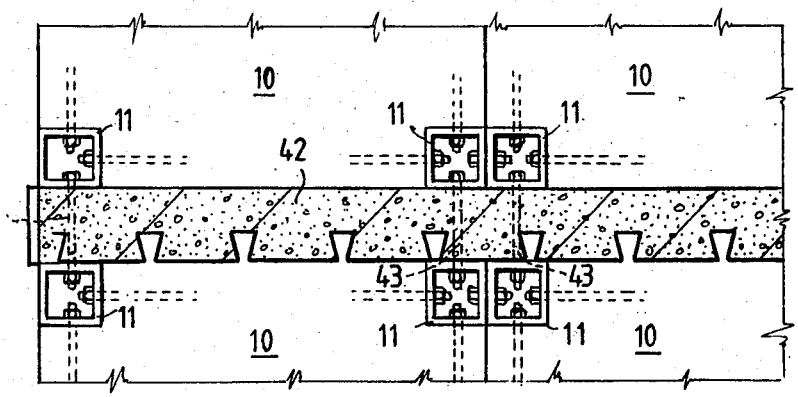
FIG. 9 is a diagrammatic partly sectioned elevational view to reduced scale showing the interconnection of building panels above and below the floor.

As shown in FIG. 9, the panels 10 may be installed below and above a floor 42, of a multi-storey building, top connectors 11 of the lower panels being connected, through the floor 42, to corresponding bottom connectors of the upper panels, by bolts 43 through the floor.

Building panels according to the invention will be found to be very effective in achieving the objects for which they have been devised. The fabrication of the panels may be carried out simply and economically in a factory or on site, and the connectors provide convenient means whereby the completed panels may be lifted and conveyed, for example by mobile cranes. The interconnection of the panels, and their anchorage to a floor and to a roofing or other super-structure may be effected quickly and easily without any high degree of skill being required.

What is claimed is:

1. A building panel of rectangular shape and substantially uniform thickness and having connectors for attachment to connectors of an adjacent similar panel, or to the floor below or superstructure above, wherein:

the connectors comprise corner connectors inset and secured into the four corners of the panel; and each corner connector is a tubular member with its ends at opposite faces of the panel and with a bolt hole with its axis substantially perpendicular to a side edge of the panel, and a further bolt hole with its axis substantially perpendicular to the bottom edge or top edge of the panel, and wherein said attachment is accomplished by means of fasteners extending through said bolt holes to an adjacent panel, or to the floor or superstructure as aforesaid.

2. A building panel according to claim 1 wherein:

each corner connector is of rectangular cross-section with one side exposed at and flush with a side of the panel and a second side exposed at and flush with the top or the bottom of the panel.

3. A building panel according to claim 2 wherein:

intermediate connectors are inset and secured in the top and the bottom of the panel, each intermediate connector being a rectangular tubular member with its ends at opposite faces of the panel, one face, formed with a bolt hole, being exposed at and flush with the top or the bottom of the panel.

4. A building panel according to claim 3 wherein:

the panel is of reinforced concrete; and each of the connectors of the panel is rigidly secured to reinforcing rods within the panel.

5. A building panel according to claim 4 wherein:

each of the connectors of the panel is a square-section tubular member with a bolt hole in each of its four sides; and threaded members rigidly fixed to the reinforcing rods extend through the bolt holes of at least two of the sides of the connector and are engaged by nuts.

* * * * *